US007159671B2

(12) United States Patent
Söderlund

(10) Patent No.: US 7,159,671 B2
(45) Date of Patent: Jan. 9, 2007

(54) POWER TOOL WITH REVERSE GEARING OPERATED BY EXTERNAL MANEUVER RING

(75) Inventor: Per Thomas Söderlund, Stockholm (SE)

(73) Assignee: Atlas Copco Tools AB, Nacka (SE)

( * ) Notice: Subject to any disclaimer, the term of this patent is extended or adjusted under 35 U.S.C. 154(b) by 0 days.

(21) Appl. No.: 10/547,494

(22) PCT Filed: Mar. 3, 2004

(86) PCT No.: PCT/SE2004/000288

§ 371 (c)(1),
(2), (4) Date: Aug. 31, 2005

(87) PCT Pub. No.: WO2004/078420

PCT Pub. Date: Sep. 16, 2004

(65) Prior Publication Data

US 2006/0162945 A1 Jul. 27, 2006

(30) Foreign Application Priority Data

Mar. 3, 2003 (SE) ..... 0300540

(51) Int. Cl.
*E21B 1/04* (2006.01)
*E21B 1/14* (2006.01)

(52) U.S. Cl. ..... 173/217; 173/216

(58) Field of Classification Search ..... 173/48, 173/216, 217, 176; 475/265, 320; 74/337.5
See application file for complete search history.

(56) References Cited

U.S. PATENT DOCUMENTS 4,255,987 A * 3/1981 Ciolli ..... 475/270
4,274,304 A * 6/1981 Curtiss ..... 475/270
4,364,286 A * 12/1982 Ciolli ..... 475/270
4,573,370 A * 3/1986 Clemens ..... 74/337.5
5,692,575 A 12/1997 Hellstrom

* cited by examiner

*Primary Examiner*—Sameh H. Tawfik
*Assistant Examiner*—Nathaniel Chukwurah
(74) *Attorney, Agent, or Firm*—Frishauf, Holtz, Goodman & Chick, P.C.

(57) ABSTRACT

A power tool comprises a housing (10) with a cylindrical outer surface (11), a rotation motor, and a power train including a reverse gearing (14, 24) with a first planetary gearing (14) for "forward" operation and a second planetary gearing (24) for "reverse" operation, and a ring gear mechanism (19, 26, 40) for establishing a reaction torque support relative to the housing (10) by coupling either one of the first planetary gearing (14) and the second planetary gearing (24) to the housing (10) to thereby shift the power transmission from a "forward" operation mode to a "reverse" operation mode, wherein the gear ring mechanism comprises a separate rotatable ring gear (19, 26) for each planetary gearing (14, 24) and an axially displaceable coupling ring (40) for alternative engagement with the ring gears (19, 26). The coupling ring (40) is connected to a maneuver ring (53; 153) which is rotatably supported on the outer surface (11) of the housing (10), and screw mounted sleeves (48, 49) extend radially from the coupling ring (40) to co-operate with helical slots (50) in the housing (10) for transforming rotational movement of maneuver ring (53) to axial displacement of the coupling ring (40). An open ended leaf spring element (60; 160) is mounted inside the maneuver ring (53; 153) and pre-tensioned to embrace the outer surface (11) of the housing (10), thereby forming a releasable arresting means for the maneuver ring (53; 153). The leaf spring element (60; 160) has apertures (71, 72; 171, 172) for locking engagement with shoulders (66, 67; 166, 167) formed by wire elements attached to the housing (10).

6 Claims, 3 Drawing Sheets

POWER TOOL WITH REVERSE GEARING OPERATED BY EXTERNAL MANEUVER RING

This application is a U.S. National Phase Application under 35 USC 371 of International Application PCT/SE2004/000288 filed Mar. 3, 2004.

The invention relates to a power tool having a reverse gearing shiftable between a "forward" operation mode and a "reverse" operation mode by a maneuver ring supported on the outside of the tool housing for rotation between two extreme positions corresponding to the two operation modes of the gearing.

A power tool of the above type is previously described in U.S. Pat. No. 5,692,575. The described tool is a reversible power wrench for tightening screw joints.

A problem concerned with power tools of this type is the risk for unintentional rotation of the maneuver ring and, hence, an undesired shifting of the gearing which would interfere with the working process. There are reaction forces transferred to the maneuver ring from the reverse gearing which could make the latter move unintentionally.

The main object of the invention is to provide a power tool of the above described type in which there is provided an easily operable means for arresting the maneuver ring in either one of the extreme positions, thereby preventing unintentional rotation of the maneuver ring and, hence, unintentional shifting of the gearing.

Further objects and advantages of the invention will appear from the following specification and claims.

A preferred embodiment of the invention is below described in detail with reference to the accompanying drawings.

In the drawings

Figure 1:
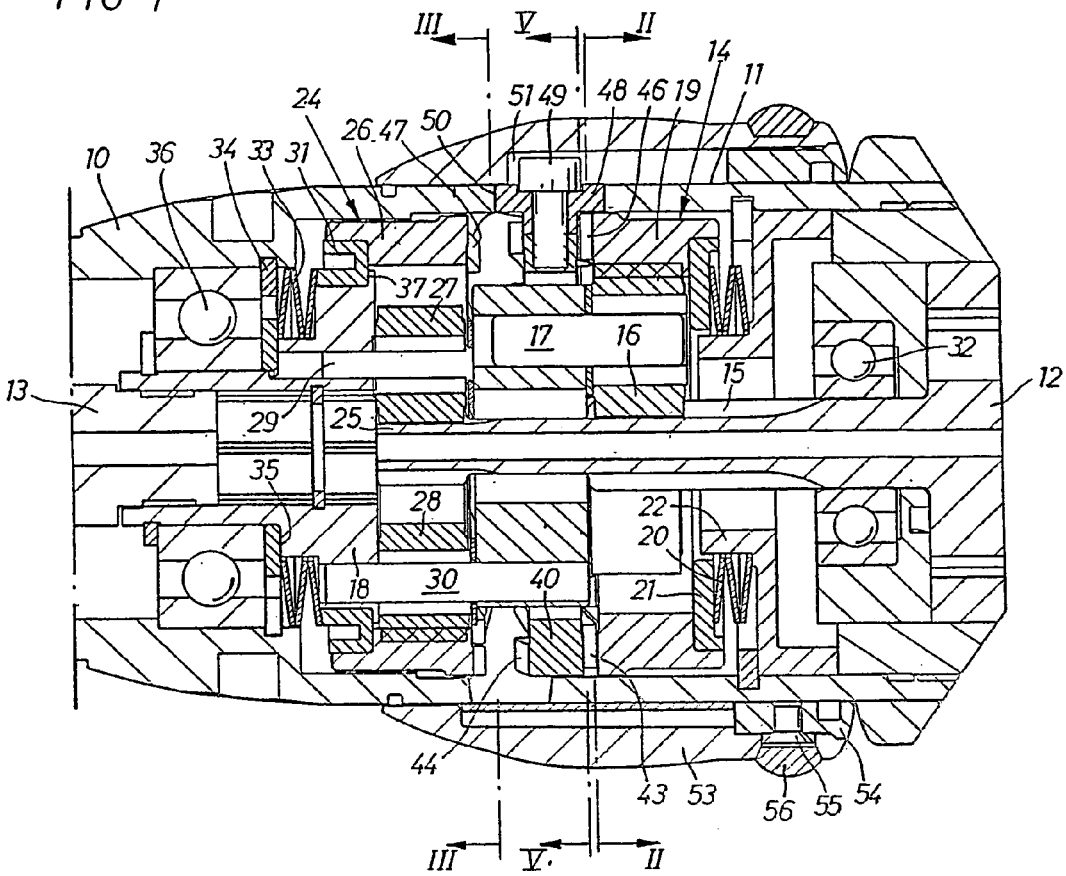
FIG. 1 shows a longitudinal section through the transmission part a power wrench according to the invention.
Figure 4:
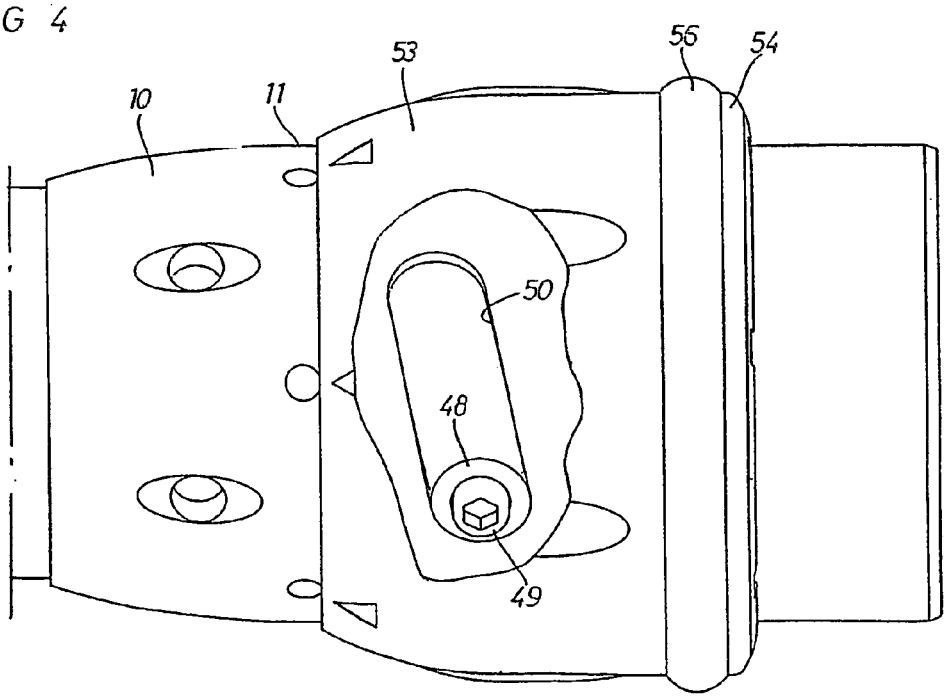
FIG. 4 shows a partly broken side view of the device in FIG. 1.
Figure 2:
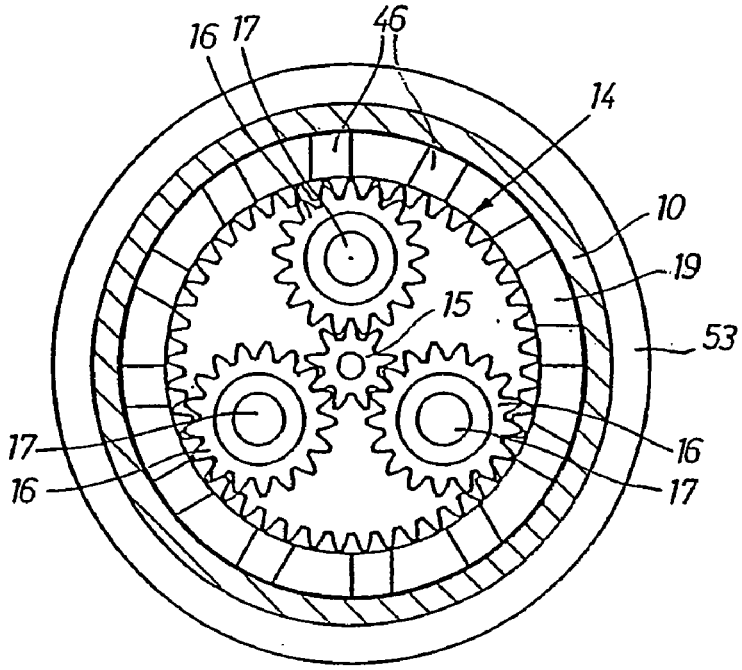
FIG. 2 shows a cross section along line II—II in FIG. 1.

The power tool described below and illustrated in the drawings is a reversible power wrench which comprises a housing 10 with a cylindrical outer surface 11, a rotation motor (not shown), a power transmission including a driving spindle 12, and a driven spindle 13 for connection to an output shaft (not shown). The power transmission comprises a first planetary gearing 14 for "forward" operation of the output shaft, and a second planetary gearing 24 for "reverse" operation.

The first planetary gearing 14 comprises a sun gear 15 formed as a part of the driving spindle 12, three planet wheels 16 each supported on a stub axles 17 mounted on a planet wheel carrier 18. The first planetary gearing 14 also comprises a ring gear 19 which is rotatable and to some extent axially displaceable relative to the housing 10. A thrust ring 21 is mounted on the ring gear 19, and a pack of washer springs 20 is arranged to apply a bias force on the thrust ring 21 and the ring gear 19 towards the left in FIG. 1. The washer spring pack 20 takes support on a ring element 22 in the housing 10, and the stub axles 17 forms an abutment for the thrust ring 21 to define the normal operation position of the ring gear 19. By this spring bias arrangement the ring gear 19 may yield axially in certain situations which will be further described below.

Figure 3:
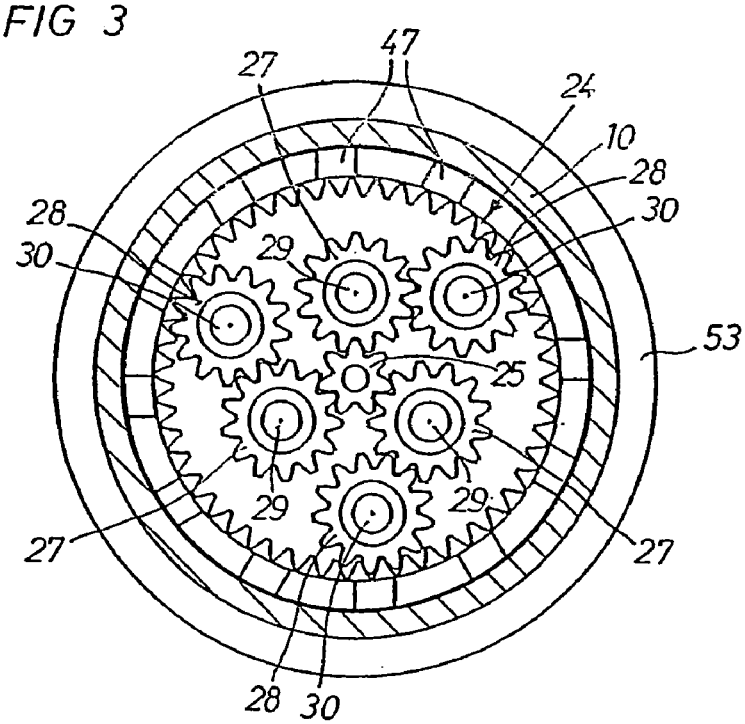
FIG. 3 shows a cross section along line III—III in FIG. 1.

The power transmission further comprises a second planetary gearing 24 including a sun gear 25 which like the sun gear 15 of the first planetary gearing 14 is formed as an integral part of the driving spindle 12. The second planetary gearing 24 also includes a ring gear 26, and two sets of planet wheels 27,28 supported on stub axles 29,30 secured to the planet wheel carrier 18 which, accordingly, is common to both planetary gearings 14,24. The planet wheels 27,28 are arranged in three series connected pairs such that one of the wheels 27 in each pair engages the sun gear 25 and the other wheel 28 engages the ring gear 26. See FIG. 3. This means that the second planetary gearing 24 will make the driven spindle 13 rotate in a reverse direction in relation to the driving spindle 12.

Like the first planetary gearing 14, the ring gear 26 of the second planetary gearing 24 is provided with a thrust ring 31, and a package of washer springs 33 is inserted between the thrust ring 31 and a support ring 34. The latter is mounted between a shoulder 35 on the planet wheel carrier 18 and a bearing 36 supporting the driven spindle 13. A shoulder 37 on the planet wheel carrier 18 forms an abutment for the thrust ring 31 and defines the normal operating position of the ring gear 26. The driving spindle 12 is supported in a bearing 32.

Between the two ring gears 19 and 26 there is movably supported a coupling ring 40. On its opposite end surfaces the coupling ring 40 is provided with coupling teeth 43,44 for alternative engagement with matching coupling teeth 46,47 on the ring gears 19 and 26, respectively. For enabling movement of the coupling ring 40, the latter is provided with a radial projection in the form of stepped sleeves 48 which is secured to the coupling ring 40 by three screws 49. The head of each screw 49 is received in a through aperture 51 in a maneuver ring 53 which is rotatable as well as axially displaceable on the outer surface 11 of the housing 10. The sleeves 48 are slidably received in helically extending slots 50 in the housing 10, and the maneuver ring 53 is arranged to move the coupling ring 40 axially via a caming action between the slots 50 and the sleeves 48 when rotated. The rotational displacement of the maneuver ring 53 as well as the axial displacement of the coupling ring 40 is limited by the extent of the slot 50. The apertures 51 in the maneuver ring 53 are axially closed by a stop ring 54 which is secured to the maneuver ring 53 by screws 55. The heads of the screws 55 are covered by an elastic band 56 mounted on the maneuver ring 53.

Inside the maneuver ring 53 there is arranged an arresting means for releasably arresting the maneuver ring 53 in either one of its end positions. This arresting means comprises a leaf spring element 60 which has the shape of an open ended ring which is radially pre-tensioned to exert an embracing force on the outer surface 11 of the housing 10. The end portions 61,62 of the leaf spring element 60 are arranged to abut against two oppositely facing abutment surfaces 64,65 on the maneuver ring 53 such that the spring element 60 is to be lifted off the housing surface 11 via one of its end portions 61,62 as the maneuver ring 53 is rotated in either direction.

Figure 5:
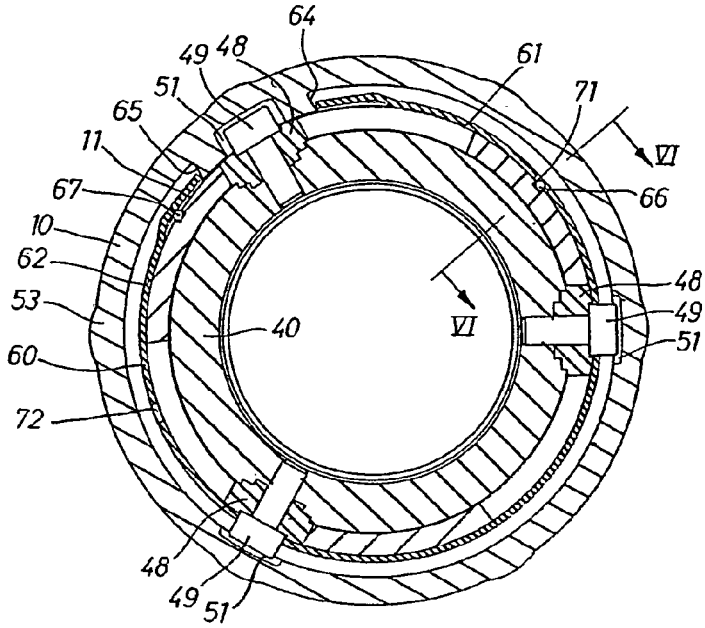
FIG. 5 shows a cross section along line V—V in FIG. 1.

Two engagement shoulders in the form of wire elements 66,67 are provided on the outer surface 11 of the housing 10, and lock surfaces in the form of transverse apertures 71,72 in the spring element 60 are arranged to co-operate with the wire elements 66,67 to arrest the spring element 60 and the maneuver ring 53 against undesirable movement. The wire elements 66,67 and the apertures 71,72 are located so as to make one of the apertures 71 engage one of the wire elements 66 in one end position of the ring element 53, whereas the other one of the apertures 72 will co-operate with the other wire element 67 as the maneuver ring 53 occupies its other end position. See FIG. 5.

Figure 6:
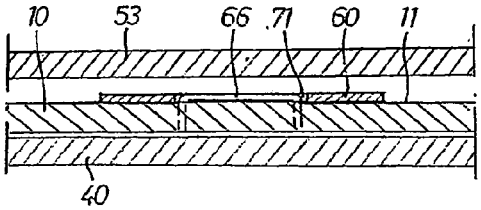
FIG. 6 shows a detail view of the maneuver ring arresting means.

Each one of the wire elements 66,67 has the shape of a staple inserted in bores in the outer surface 11 of the housing 10. See FIG. 6.

Figure 7:
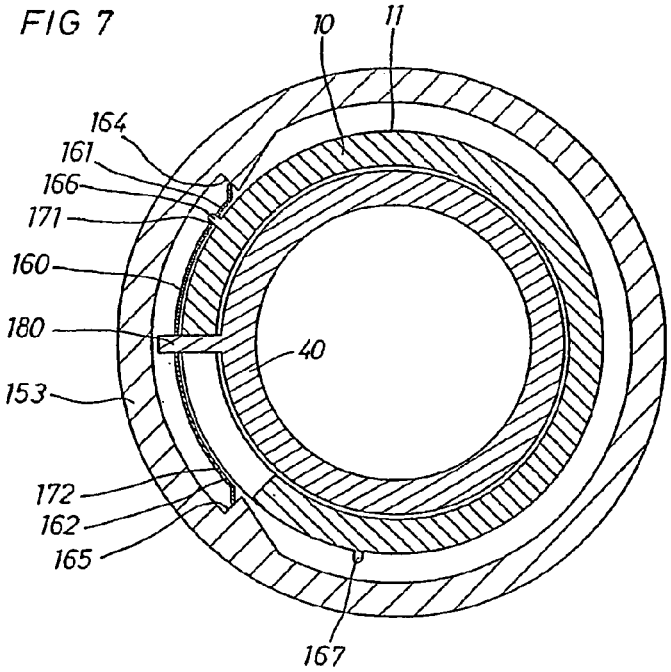
FIG. 7 shows a cross section through the maneuver ring arresting means according to an alternative embodiment of the invention.

In FIG. 7, there is illustrated an alternative embodiment of the invention wherein the maneuver ring 153 is arrested in its end positions by a leaf spring element 160 which extends over just a quarter of the circumference of the outer surface 11 of the housing 10. The end portions 161,162 of the spring element 160 abut against oppositely facing shoulders 164, 165 on the maneuver ring 153 and are arranged to be lifted one at a time by the maneuver ring 153 when rotating the latter. The spring element 160 has two apertures 171,172 for co-operating with two engagement shoulders 166,167 on the housing 10 for locking the maneuver ring 153 against undesirable movement. The arresting action between an aperture and an engagement shoulder is discontinued as the maneuver ring 153 is rotated and the respective end portion of the spring element 153 is lifted to disengage the aperture from the respective engagement shoulder. The spring element 160 is positively locked to the coupling ring 42 by means of a radial arm 180 on the latter.

In operation, the power transmission transfers torque from the motor via the driving spindle 12, the first planetary gearing 14 or the second planetary gearing 24 to the output end of the wrench. During normal screw joint tightening operations the motor power is transferred via the first planetary gearing 14, i.e. the output shaft is rotated in the "forward" direction. Let us assume that the gearing at start occupies its "reverse" mode and that it has to be shifted to its "forward" mode. In the "reverse" mode the ring gear 26 of the second planetary gearing 24 is locked against rotation via the teeth 44,47, the coupling ring 40, the sleeves 48 and the helical slots 50.

To accomplish shifting of the gearing to its "forward" mode the maneuver ring 53 is rotated, and at the very start of the rotation movement of the maneuver ring 53 the abutment surface 64 engages the end portion 61 of the spring element 60, thereby lifting the latter off the housing surface 11 to disengage the aperture 71 from the wire element 66. When the maneuver ring 53 is rotated further the coupling ring 40 is urged to move axially due to the co-operation between the sleeves 48 and the helical slots 50 into a position in which the coupling teeth 43 engages the coupling teeth 46 of the ring gear 19 of the first planetary gearing 14. Now, the ring gear 19 is prevented from rotating any further relative to the housing 10 in that the sleeves 48 abut the end portions of the slots 50, which means that the driving torque delivered by the driving spindle 12 is transferred to the planet carrier 18 via the planet wheels 16 while the reaction torque is transferred to the housing 10 via the ring gear 19, the coupling ring 40 and the sleeves 48. The second planetary gearing 24 remains inactive since the ring gear 26 of that gearing is disengaged from the coupling ring 40 and the housing 10, which means that it can rotate freely and does not transfer any torque reaction to the housing 10.

The maneuver ring 53 is arrested against undesired rotation in that the aperture 72 now engages the wire element 67.

If a screw joint is to be loosened, i.e. be rotated in the reverse direction, the power transmission has to be shifted to its reverse operation mode. This is obtained by turning the maneuver ring 53 in the opposite direction such that by caming action between the slots 50 and the sleeves 48 the coupling ring 40 is axially displaced away from the ring gear 19 of the first planetary gearing 14 toward the ring gear 26 of the second planetary gearing 24. Thereby, the engagement between the teeth 46 on the ring gear 19 of the first planetary gearing 14 and the teeth 43 of the coupling ring 40 is discontinued, and instead engagement between the teeth 47 on the ring gear 26 of the second planetary gearing 24 and the teeth 44 of the coupling ring 40 is established. The rotation of the maneuver ring 53 is started, however, by an engagement between the abutment surface 65 and the end portion 62 of the spring element 60, whereby the end portion 62 is lifted to disengage the aperture 72 from the wire element 67.

In this position of the coupling ring 40, the motor torque delivered via the driving spindle 12 and the sun gear 25 is transferred to the driven spindle/planet carrier 18 via the series connected pairs of planet wheels 27,28, whereas the torque reaction is transferred from the ring gear 26 to the housing 10 via the coupling ring 40 and the sleeves 48. The ring gear 19 of the first planetary gearing 14 is now free to rotate in the housing 10 and does not transfer any torque reaction to the housing 10. Accordingly, the first planetary gearing 14 is made inactive, and the aperture 71 is engaged by the wire element 66 to arrest the maneuver ring 53 against undesired further movement.

Should when operating the maneuver ring 53 for instance the teeth 44 of the coupling ring 40 hit the coupling teeth 47 on the ring gear 26 top-on-top, the gear shifting operation could be disturbed and difficult to execute. A rotational movement of the transmission has to be performed to get the teeth into shifting positions, which usually means that the operator starts the motor hoping that the coupling teeth will find their right positions automatically. If that is not succeeded the coupling ring 40 gets jammed between the coupling teeth 44,47 and the slot 50 in the housing 10.

In order to enable the operator to get a quick and trouble-free gear shifting even in cases where for instance the coupling teeth 43 on the coupling ring 40 and the coupling teeth 46 on the ring gear 19 hit each other top-on-top the ring gear 19 yields axially against the bias force of the washer springs 20 such that a further rotational movement of the coupling ring 40 may take place without getting stuck. Thereby, a quick and easy gear shifting may take place.

In the same way the ring gear 26 may be axially displaced due to yielding of the washer springs 33 in case the coupling teeth 44 of the coupling ring 26 should hit top-on-top the teeth 47 of the ring gear 26. As in the above described way the coupling ring 40 may be rotated further to facilitate a correct engagement with the ring gear 26.

The maneuver ring 53 arresting means including the leaf spring element 60 with locking apertures 71,72, and the engagement shoulders formed by the wire element 66,67 on the housing 10 gives a protection against undesired movement of the maneuver ring 53 and, hence, an undesired shifting of the coupling ring 40 as a result of forces transferred from either one of the ring gears 19,26.

The invention claimed is:

1. A power tool comprising a housing with a substantially cylindrical outer surface, a rotation motor, a power train, and an output shaft, wherein said power train comprises a reverse gearing shiftable between a forward operation mode and a reverse operation mode, and a maneuver ring connected to the reverse gearing and rotatably supported on the housing outer surface for rotation between two extreme positions for shifting the gearing between the forward operation mode and the reverse operation mode, wherein:

an arresting device is provided between the maneuver ring and the housing to releasably arrest the maneuver ring in either one of said extreme positions, said arresting device comprises an open ended leaf spring element which extends along a part of the circumference of the housing outer surface and which has two end portions each being formed with a lock surface, and two engagement shoulders provided on the housing outer surface each being arranged to be engaged by one of said lock surfaces, and said maneuver ring comprises two oppositely facing abutment surfaces each abutment surface being arranged to engage one of said leaf spring element end portions at rotational movement of said maneuver ring in either direction, thereby lifting either one of said leaf spring element end portions to disengage the respective lock surface from a corresponding engagement shoulder on the housing outer surface and releasing the maneuver ring for rotation from one of said extreme positions to the other.

2. The power tool according to claim 1, wherein said engagement shoulders comprise wire elements secured to the housing outer surface and extending in an axial direction of the maneuver ring.

3. The power tool according to claim 2, wherein said leaf spring extends over at least ⅕ of the circumference of the housing outer surface.

4. The power tool according to claim 1, wherein said leaf spring extends over at least ⅕ of the circumference of the housing outer surface.

5. The power tool according to claim 2, wherein said leaf spring element extends over more than ½ the circumference of the housing outer surface.

6. The power tool according to claim 1, wherein said leaf spring element extends over more than ½ the circumference of the housing outer surface.

* * * * *